United States Patent [19]

Asano et al.

[11] Patent Number: 4,523,763

[45] Date of Patent: Jun. 18, 1985

[54] TURBOCHARGER LUBRICATING OIL SEALING METHOD

[75] Inventors: Masumi Asano, Toyota; Mitsuyuki Ugajin, Okazaki; Kiyoshi Isogai, Toyota, all of Japan

[73] Assignee: Toyota Jidosha Kabushiki Kaisha, Japan

[21] Appl. No.: 627,660

[22] Filed: Jul. 3, 1984

[30] Foreign Application Priority Data

Jul. 8, 1983 [JP] Japan ..... 58-106636[U]

[51] Int. Cl.[3] ..... F16J 15/40

[52] U.S. Cl. ..... 277/1; 277/15; 277/59; 277/53

[58] Field of Search ..... 277/53-57, 277/59, 3, 15, 1

[56] References Cited

U.S. PATENT DOCUMENTS

| | | | |
|---|---|---|---|
| 2,925,290 | 2/1960 | Greenwood | 277/53 |
| 2,936,715 | 5/1960 | Southham | 277/53 |
| 3,519,277 | 7/1970 | Crocker | 277/53 |
| 4,018,059 | 4/1977 | Hatch | 277/15 |
| 4,114,059 | 9/1978 | Albaric et al. | 277/59 |
| 4,364,241 | 12/1982 | Okamoto et al. | 277/59 |

FOREIGN PATENT DOCUMENTS

| | | |
|---|---|---|
| 2853525 | 12/1978 | Fed. Rep. of Germany . |
| 1203602 | 1/1960 | France . |
| 1574942 | 9/1980 | United Kingdom . |

*Primary Examiner*—Robert I. Smith
*Attorney, Agent, or Firm*—Parkhurst & Oliff

[57] ABSTRACT

A lubricating oil sealing apparatus for use of a turbocharger having a compressor wheel for supplying a supercharged air through an intake passage, a turbine wheel driven by a force of an exhaust gas, and a driving shaft connecting the compressor wheel with the turbine wheel. The apparatus is located between the compressor wheel and turbine wheel, and has a labyrinth structure therein in order to prevent the lubricating oil from being suctioned into the intake passage.

16 Claims, 16 Drawing Figures

TURBOCHARGER LUBRICATING OIL SEALING METHOD

BACKGROUND OF THE INVENTION

The present invention relates to a turbocharger lubricating oil sealing apparatus, and more particularly to an oil sealing apparatus which can be easily assembled.

In general, as shown in FIG. 1, a turbine wheel 2 is directly connected by a driving shaft 3 to a compressor wheel 4 within a turbocharger 1. When the turbine wheel 2 rotates with a pressure of an exhaust gas discharged from a combustion chamber 5, the rotation of the turbine wheel 2 is transmitted by the driving shaft 3 to the compressor wheel 4, thereby resulting in the rotation of the compressor wheel 4. This supplies a supercharged air into the combustion chamber 5.

In general, it takes a relatively length time to assemble a turbocharger. Hence, it has been requested to shorten the time necessary to assemble a turbocharger. The reason why it takes a relatively length time to assemble a turbocharger, a turbocharger includes a lubricating oil sealing apparatus therein. The structure of such an oil sealing apparatus is explained hereunder.

In the turbocharger 1, as shown in FIG. 9, the driving shaft 3 is lubricated with an oil introduced from an opening 6. After the lubricating oil lubricates the driving shaft 3 and so forth, the oil returns from an outlet opening 7 to a crank case (not shown in drawings) of an engine 8 shown in FIG. 1. However, a part of the oil happens to be suctioned by a vacuum into an intake passage 9 shown in FIG. 1, thereby resulting in the composition within the combustion chamber 5 of the engine 8. Such a vacuum is generated by a venturi effect occurred when an air flows through a restricted passage 12 defined between a compressor housing 10 and a center housing 11, shown in FIG. 9. Further, when a throttle valve 13 (shown in FIG. 1) rapidly opens, a vacuum occurs in the intake passage 9 according to the time delay responding to the compressor wheel 4. Such a consumption of the lubricating oil in the combustion chamber 5 is not preferable from the standpoint that the consumption of the lubricating oil causes an unusual combustion within the engine 8, the occurrence of a white smoke, and a decrease in a lubricating oil.

To obviate the foregoing drawbacks, a conventional turbocharger 1 includes a lubricating oil sealing apparatus 17 as shown in FIG. 9. This lubricating oil sealing apparatus 17 comprises a sealing collar 14, a retainer 15, and a deflector 16. The sealing collar 14 is fitted with some amount of pressure into the driving shaft 3. The retainer 15 is mounted on the center housing 11. The deflector 16 is mounted between the retainer 15 and a thrust bearing 19. The sealing collar 14 includes a sealing ring 27 thereon. The sealing collar 14 has a radial projection 18 which is a form of a disc plate. The projection 18 extends in a parallel relationship with the retainer 15 with a small clearance $t_1$. Further, the projection 18 extends in a parallel relationship with the deflector 16 with a small clearance $t_2$. Thus, the combination of the retainer 15, the projection 18 and the deflector 16 constitutes a structure which performs a labyrinth effect. The lubricating oil sealing apparatus 17 prevents the oil from being suctioned into the intake passage 9 by the effect of a labyrinth mechanism and further by the use of the sealing ring 27.

When the lubricating oil sealing apparatus 17 is assembled into the turbocharger 1, parts of the apparatus 17 are assembled by the following order.

Firstly, as shown in FIG. 11, the thrust bearing 19 is mounted on the driving shaft 3 in the condition shown in FIG. 10. Next, as shown in FIG. 12, a thrust collar 20 is fitted with some amount of pressure into the driving shaft 3. Next, as shown in FIG. 13, the deflector 16 is attached to the side wall of the thrust bearing 19. The sealing collar 14 is fitted with some amount of pressure on the driving shaft 3, as shown in FIG. 14. Further, as shown in FIG. 15, the retainer 15 is mounted on the outer peripheral portion of the sealing collar 14, and the deflector 16 is held between the retainer 15 and the thrust bearing 19. Next, as shown in FIG. 16, a stop ring 24 fastens the retainer 15 to the center housing 11. Thus, according to a prior lubricating oil sealing apparatus 17, it is troublesome to assemble the lubricating oil sealing apparatus 17 into a turbocharger. Hence, it takes a length time to assemble a turbocharger.

SUMMARY OF THE INVENTION

The present invention was made in view of the foregoing background and to overcome the foregoing drawbacks. It is accordingly an object of this invention to provide a turbocharger lubricating oil sealing apparatus which can be assembled in a short time.

To attain the above objects, a turbocharger lubricating oil sealing apparatus according to the present invention for use of a turbocharger having a compressor wheel for supplying a supercharged air through an intake passage, a turbine wheel driven by a force of an exhaust gas, and a driving shaft connecting the compressor wheel with the turbine wheel, the apparatus comprising:

a sealing collar located between the compressor wheel and the turbine wheel, the sealing collar comprising a main portion and a radially extended projection having a greater outside diameter than that of the main portion, the sealing collar having a hole therein in which the driving shaft extends;

a retainer surrounding the sealing collar a resilient means provided between an inside portion of the retainer and the outside portion of the sealing collar, for securing the sealing collar to the retainer; and a deflector fitted into the retainer, the deflector having a hole therein which the sealing collar extends through, the hole having a diameter greater than the outside diameter of the sealing collar and less than the outside diameter of the radially extended projection of the sealing collar.

BRIEF DESCRIPTION OF THE DRAWINGS

The above objects, features and advantages of the present invention will become more apparent from the following description of the preferred embodiment taken in conjunction with the accompanying drawings, wherein.

DETAILED DESCRIPTION OF THE PREFERRED EMBODIMENT

The present invention is described in detail with reference to the accompanying drawings which illustrate an embodiment of the present invention.

Figure 1:
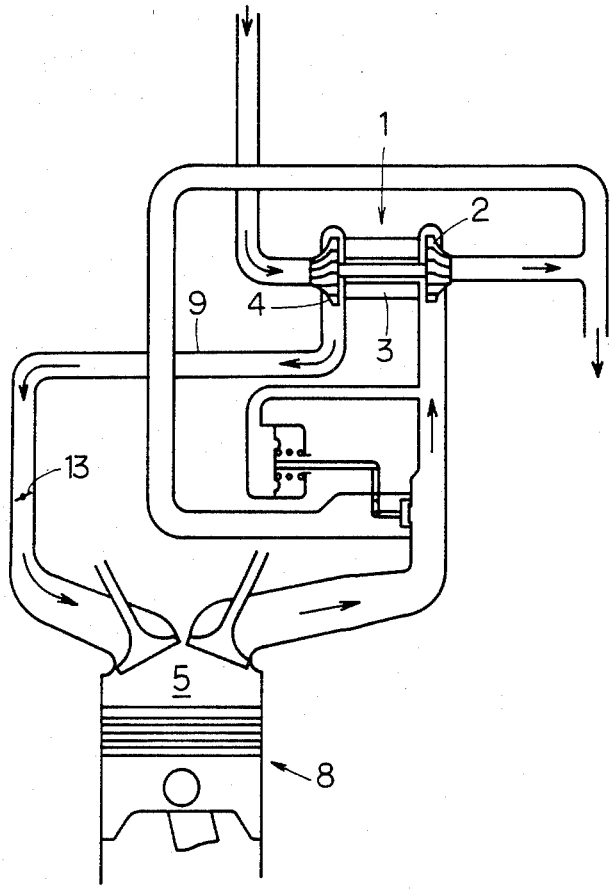
FIG. 1 is a general view of an engine in which a turbocharger lubricating oil sealing apparatus according to the present invention is applied.
Figure 2:
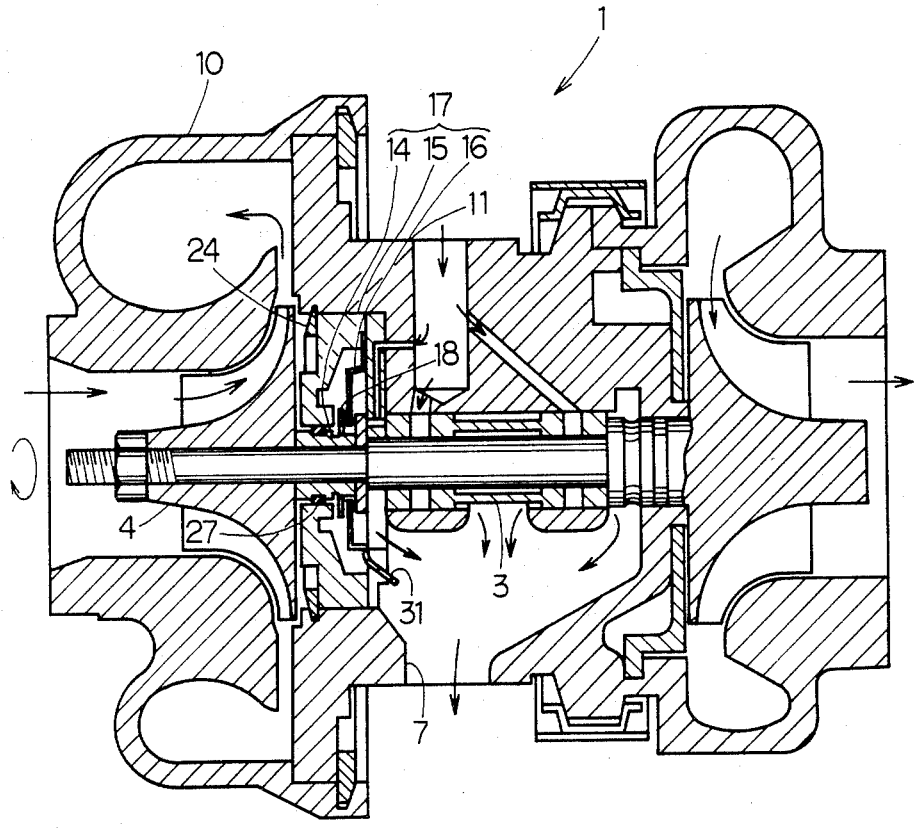
FIG. 2 is a longitudinal cross-sectional view of a turbocharger in which a lubricating oil sealing apparatus according to the present invention is applied.
Figure 3:
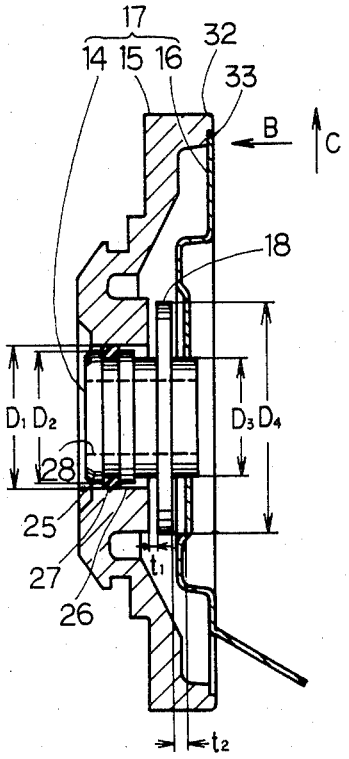
FIG. 3 is a longitudinal cross-sectional view of a lubricating oil sealing apparatus according to the present invention.

FIG. 2 illustrates a longitudinal cross-sectional view of a turbocharger in which a lubricating oil sealing apparatus according to the present invention is applied. The lubricating oil sealing apparatus 17 comprises a sealing collar 14, a retainer 15, and a deflector 16. FIG. 3 illustrates an enlarged longitudinal cross-sectional view of the lubricating oil sealing apparatus 17 shown in FIG. 2. As shown in FIG. 3, the sealing collar 14 has a radially extending projection 18 at outer periphery thereof, which is a form of a disc. Further, the sealing collar 14 has a first rib 25 and a second rib 26, both of which are circular in cross-section and radially extend in a parallel relationship with each other. A seal ring 27, made of a metal or from a rubber, is fitted in a groove defined between the first and second ribs 25 and 26. The seal ring 27 is designed to have an outside diameter D1 greater than an outside diameter D2 of the first and second ribs 25 and 26. The sealing collar 14 has a hole 28 which axially extends therein, for allowing the driving shaft 3 to extend therein.

Figure 5:
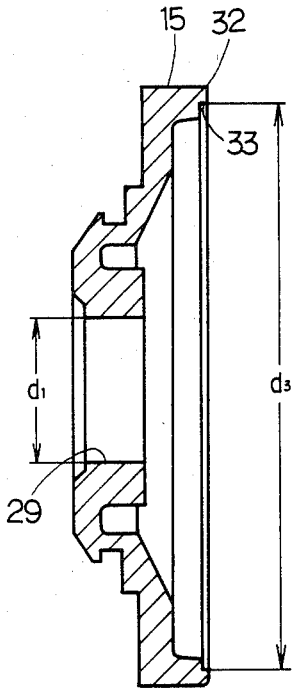
FIG. 5 is a longitudinal cross-sectional view of a retainer which is employed in the apparatus of the present invention.

FIG. 5 illustrates a longitudinal cross-sectional view of a retainer 15 which is employed in the apparatus of the present invention. The retainer 15 has a hole 29 at center thereof, in which the driving shaft 3 axially extends. An inside diameter $D_1$ of the hole 29 of the retainer 15 is designed to be slightly smaller than the outside diameter D1 of the seal ring 27 shown in FIG. 3. The retainer 15 has a stepped portion 33 adjacent to outer periphery thereof, on which the deflector 16 is fitted.

Figure 4:
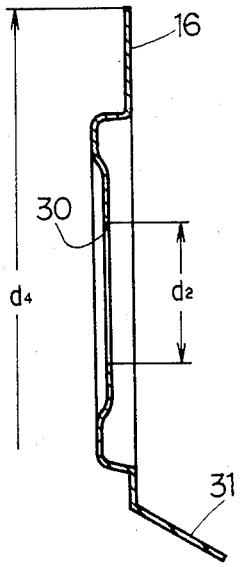
FIG. 4 is a longitudinal cross-sectional view of a deflector which is employed in the apparatus of the present invention.

FIG. 4 illustrates a longitudinal cross-sectional view of the deflector 16 which is employed in the apparatus of the present invention. The deflector 16 has a form of a disc and is provided with a circular opening 30 at center thereof. An inside diameter $d_2$ of the opening 30 is designed to be greater than the outside diameter D3 of the sealing collar 14 shown in FIG. 3 and to be less than the outside diameter D4 of the projection 8. The deflector 16 has a flange portion 31, which radially and obliquely extends, guides the lubricating oil returned to the outlet opening 7. The outside diameter $d_4$ of the deflector 16 is designed to be almost same as or slightly greater than the inside diameter $d_3$ of the stepped portion 33 of the retainer 15 shown in FIG. 5.

Figure 6:
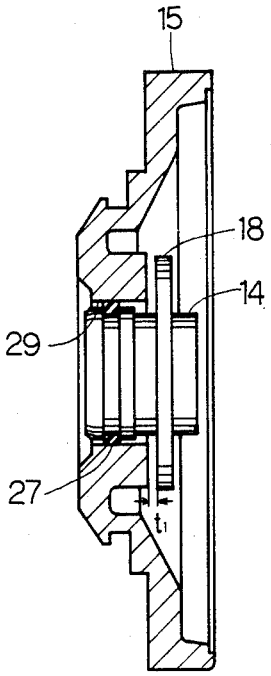
FIG. 6 is a longitudinal cross-sectional view of a lubricating oil sealing apparatus in the condition that a sealing collar is mounted on a retainer.

The sealing collar 14, the retainer 15, and the deflector 16 are assembled into one assembly by the following procedure. Firstly, the seal ring 27 is fitted into the groove defined between the first and second ribs 25 and 26 of the sealing collar 14. Next, while the seal ring 27 is held in the groove of the sealing collar 14, the sealing collar 14 is inserted into the hole 29 of the retainer 15, as shown in FIG. 6. As the outside diameter D1 of the seal ring 27 is designed to be slightly greater than the inside diameter $d_1$ of the hole 29, the outside diameter D1 of the seal ring 27 is forced to be contracted by the distance subtracted $d_1$ from $D_1$. Hence, the sealing collar 14 is retained to the retainer 15 by the seal ring 27 whose resilient force prevents the sealing collar 14 from being separate from the retainer 15. The projection 18 of the sealing collar 14 radially extends in a nearly parallel relationship with the retainer 15 with a short clearance $t_1$ between the projection 8 and the retainer 15. Next, as shown in FIG. 3, the deflector 16 is press fitted into a stepped portion 33 of the retainer 15, and is secured to the stepped portion 33 with an impact force in the direction B shown in FIG. 3. When the above impact force is applied to the deflector 16, the deflector 16 is subjected to a small amount of a plastic deformation in the direction C shown in FIG. 3. This results in the deflector 16 being secured to the stepped portion 33 of the retainer 15. In this condition, the projection 18 of the sealing collar 14 radially extends in a nearly parallel relationship with the deflector 16, and there is provided with a short clearance $t_2$ between the projection 18 and the deflector 16, as shown in FIG. 3. Further, there is provided the short clearance $t_1$ between the projection 18 and the retainer 15. Hence, a labyrinth structure is constituted between the retainer 15, the projection 18, and the the deflector 16. The lubricating oil sealing apparatus 17 prevents the oil from being leaked into the intake passage 9 owing to the labyrinth effect and the sealing effect of the seal ring 27. Thus assembled lubricating oil sealing apparatus 17 is press fitted in the driving shaft 3 of the turbocharger 1.

Figure 7:
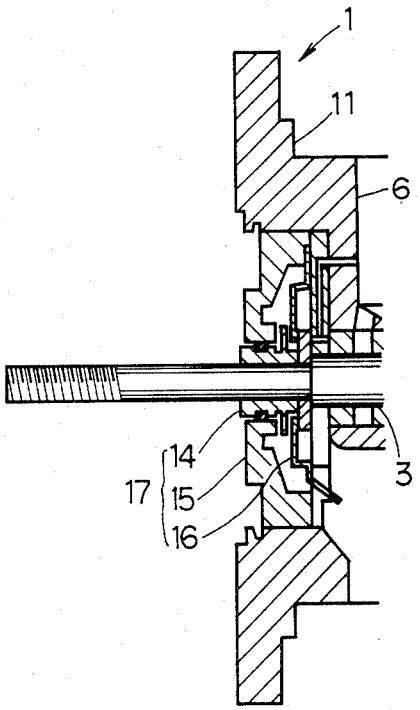
FIG. 7 is a longitudinal cross-sectional view of a lubricating oil sealing apparatus in the condition that it is under assembly.
Figure 8:
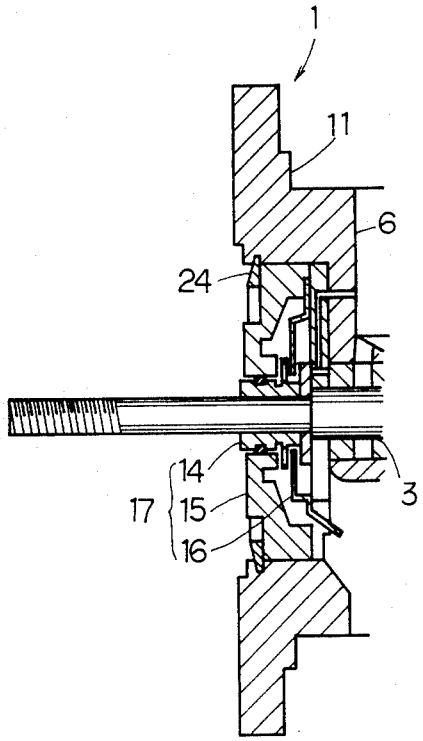
FIG. 8 is a longitudinal cross-sectional view of a lubricating oil sealing apparatus in the condition that a stop ring is added to the apparatus shown in FIG. 7.
Figure 9:
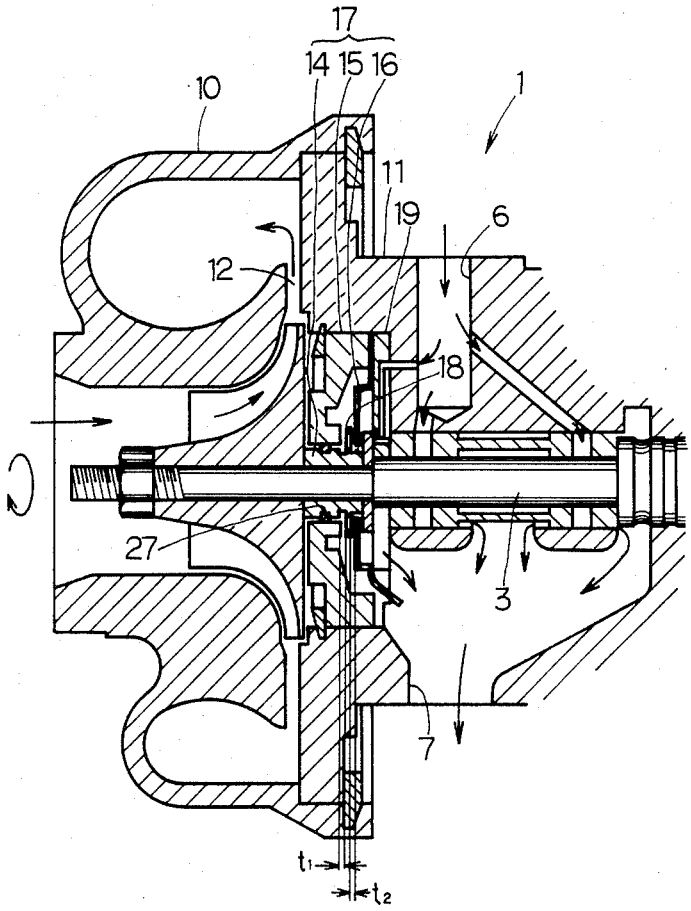
Fig. 9 PRIOR ART
FIG. 9 is a longitudinal cross-sectional view of a turbocharger in which a lubricating oil sealing apparatus according to a prior art is applied.
Figure 10:
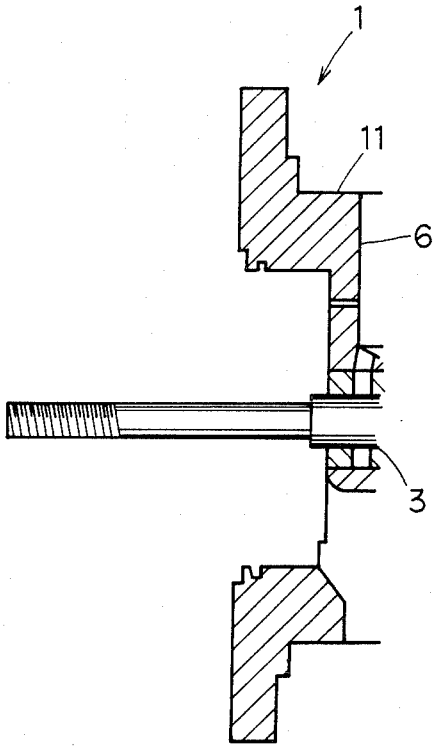
FIG. 10 is a longitudinal cross-sectional view of a part of a turbocharger which is under assembly according to a prior art.
Figure 11:
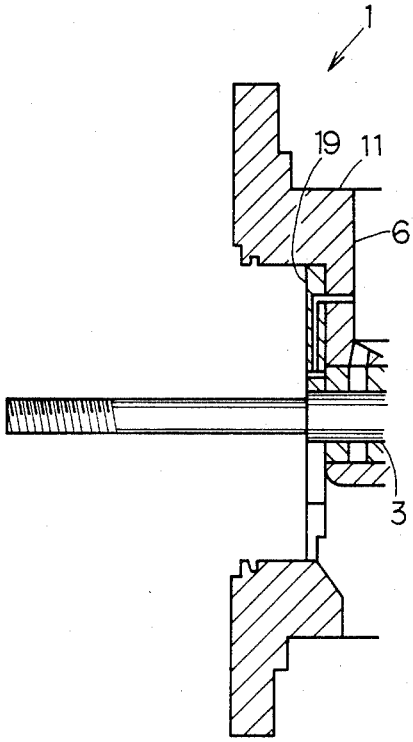
FIG. 11 is a longitudinal cross-sectional view of a turbocharger provided in the condition that a thrust bearing is mounted into the turbocharger shown in FIG. 10.
Figure 12:
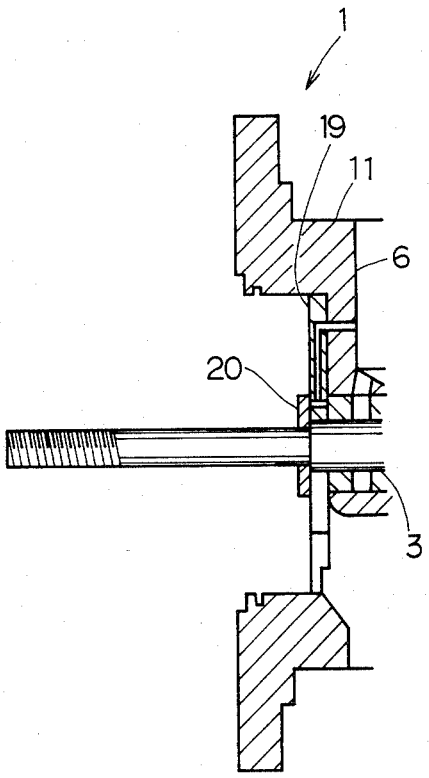
FIG. 12 is a longitudinal cross-sectional view of a turbocharger provided in the condition that a thrust collar is mounted into the turbocharger shown in FIG. 11.
Figure 13:
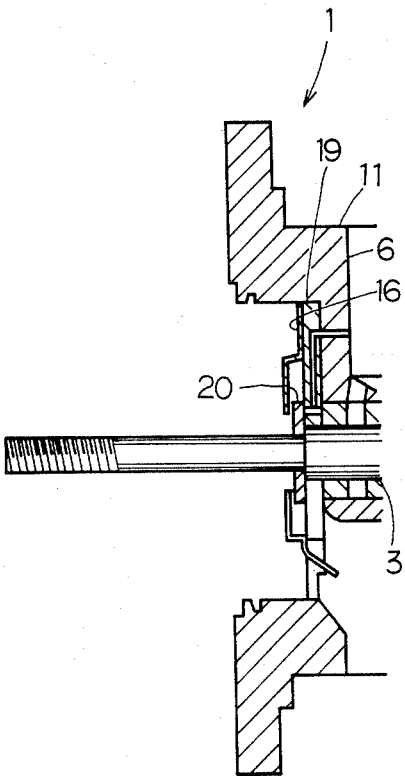
FIG. 13 is a longitudinal cross-sectional view of a turbocharger provided in the condition that a deflector is mounted into the turbocharger shown in FIG. 12.
Figure 14:
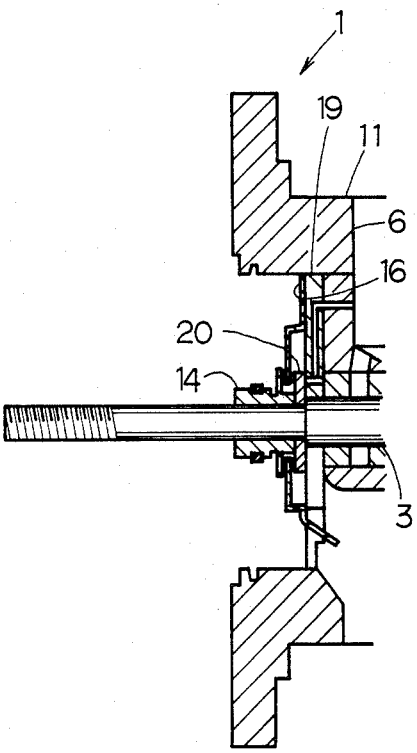
FIG. 14 is a longitudinal cross-sectional view of a turbocharger provided in the condition that a sealing collar is mounted into the turbocharger shown in FIG. 13.
Figure 15:
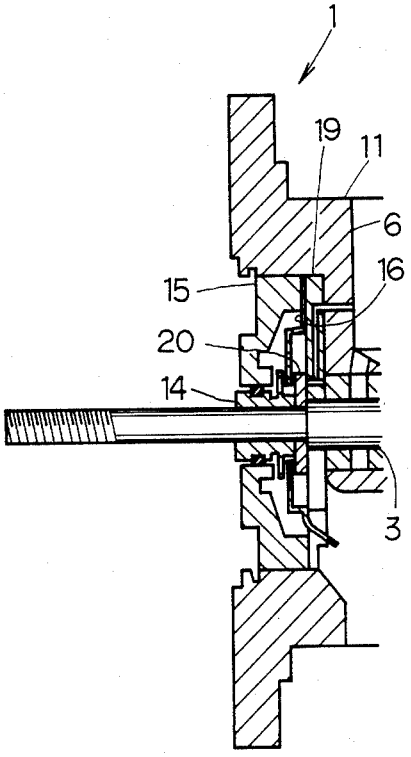
FIG. 15 is a longitudinal cross-sectional view of a turbocharger provided in the condition that a retainer is mounted into the turbocharger shown in FIG. 14.
Figure 16:
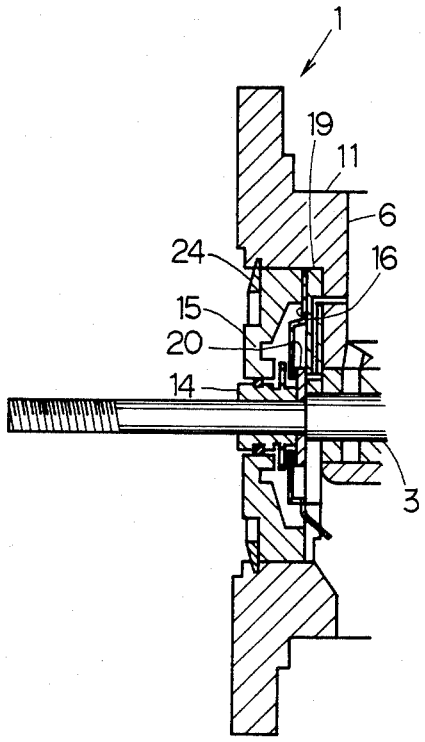
FIG. 16 is a longitudinal cross-sectional view of a turbocharger provided in the condition that a stop ring is mounted into the turbocharger shown in FIG. 15.

FIG. 7 illustrates such a condition as the lubricating oil sealing apparatus 17 is press fitted into the driving shaft 3. The lubricating oil sealing apparatus 17 is mounted to the turbocharger 1 by the way that the stop ring 24 secures the retainer 15 onto the center housing 11. Further, a compressor wheel and a compressor housing are mounted on the lubricating oil sealing apparatus shown in FIG. 8, and an assembly of a turbocharger is completed.

Thus, the lubricating oil sealing apparatus 17 accoring to the present embodiment is assembled into one body in advance. If the assembled body is mounted on a turbocharger, the assembly of the lubricating oil sealing apparatus is completed.

While the present invention has been described in its preferred embodiment, it is to be understood that the invention is not limited thereto, and may be otherwise embodied within the scope of the following claims.

What is claimed is:

1. A method of assemblying a lubricating oil sealing apparatus in a turbocharger, comprising:

placing an annular resilient sealing means around an outer peripheral portion of an annular main portion of a sealing collar, whereby an outer diameter of the annular resilient sealing means is greater than an outer diameter of the outer peripheral portion of the annular main portion of the sealing collar;

inserting the annular main portion of the sealing collar into a hole in a retainer, such that the outer diameter of the annular resilient sealing means resiliently engages an inner diameter of the hole in the retainer;

press fitting a deflector into a stepped portion of the retainer, said stepped portion of the retainer being located at an outer peripheral portion thereof and engaging an outer circumferential portion of the deflector, whereby a radially extended projection of the annular sealing collar is located between the retainer and the deflector, such an assembly comprising the oil sealing apparatus;

press fitting the oil sealing apparatus into a recess in a housing; and securing the oil sealing apparatus to the housing with an annular stop ring.

2. The method of claim 1, wherein said annular resilient sealing means is located between longitudinally spaced, radially extending annular rib portions on said main portion of the annular sealing collar.

3. The method of claim 1, wherein said stepped portion of the retainer includes a diameter which is less than the outer circumferential portion of the deflector.

4. The method of claim 1, wherein said deflector includes a flange portion which radially and obliquely extends therefrom, to guide a flow of lubricating oil.

5. The method of claim 1, wherein said annular resilient sealing means comprises metal.

6. The method of claim 1, wherein said annular resilient sealing means comprises rubber.

7. The method of claim 1, wherein a drive shaft is inserted through said oil sealing apparatus, said drive shaft connected a compression wheel and a turbine wheel together, each of said wheels being located on opposite longitudinal ends of the drive shaft.

8. The method of claim 1, wherein said radially extended projection of the sealing collar is greater in diameter than the outer diameter of the outer peripheral portion of the annular main portion of the sealing collar.

9. The method of claim 1, wherein said radially extended projection of the sealing collar is annular.

10. A method of assemblying a lubricating oil sealing apparatus in a turbocharge, comprising:

placing an annular resilient sealing means around an outer peripheral portion of an annular main portion of a sealing collar and between longitudinally spaced, radially extending annular rib portions, whereby an outer diameter of the annular resilient sealing means is greater than an outer diameter of the outer peripheral portion of the annular main portion of the sealing collar;

inserting the annular main portion of the sealing collar into a hole in a retainer, such that the outer diameter of the annular resilient sealing means resiliently engages an inner diameter of the hole in the retainer;

press fitting a deflector into a stepped portion of the retainer, said stepped portion of the retainer being located at an outer peripheral portion thereof and engaging an outer circumferential portion of the deflector, said stepped portion having a diameter which is less than the outer circumferential portion of the deflector, whereby a radially extended annular projection of the annular sealing collar is located between the retainer and the deflector, such an assembly comprising the oil sealing apparatus;

press fitting the oil sealing apparatus into a recess in a turbocharger housing;

securing the oil sealing apparatus to the housing with an annular stop ring; and inserting a drive shaft through said oil sealing apparatus.

11. The method of claim 10, wherein said deflector includes a flange portion which radially and obliquely extends therefrom, to guide a flow of lubricating oil.

12. The method of claim 10, wherein said annular resilient sealing means comprises metal.

13. The method of claims 10, wherein said annular resilient sealing means comprises rubber.

14. The method of claim 10, wherein said radially extended projection of the sealing collar is greater in diameter than the outer diameter of the outer peripheral portion of the annular main portion of the sealing collar.

15. The method of claim 10, wherein a compression wheel is mounted on a first end of the drive shaft.

16. The method of claim 10, wherein a turbine wheel is mounted on a second end of the drive shaft.

* * * * *